United States Patent [19]

Weber et al.

[11] Patent Number: 4,674,428

[45] Date of Patent: Jun. 23, 1987

[54] VARIBLE OUTHAUL WISHBONE BOOM FOR BOARD SAILOR

[76] Inventors: Matthew D. Weber, 1899 Dennison St., Oakland, Calif. 94606; Clifford D. Stewart, 740 Oakland Avenue, Apt. 311, Oakland, Calif. 94611

[21] Appl. No.: 809,185

[22] Filed: Dec. 16, 1985

[51] Int. Cl.[4] ..... B63H 9/00

[52] U.S. Cl. ..... 114/39; 114/98; 114/99; 114/102

[58] Field of Search ..... 114/39.2, 97–99, 114/102

[56] References Cited

U.S. PATENT DOCUMENTS

| | | | |
|---|---|---|---|
| 4,112,865 | 9/1978 | Carn | 114/39.2 |
| 4,516,873 | 5/1985 | Humble et al. | 114/39.2 |

FOREIGN PATENT DOCUMENTS

| | | | |
|---|---|---|---|
| 2837534 | 3/1980 | Fed. Rep. of Germany | 114/39.2 |
| 3030495 | 3/1982 | Fed. Rep. of Germany | 114/98 |
| 3125806 | 1/1983 | Fed. Rep. of Germany | 114/39.2 |
| 3304286 | 9/1983 | Fed. Rep. of Germany | 114/97 |
| 2453776 | 12/1980 | France | 114/98 |
| 2551022 | 3/1985 | France | 114/97 |

*Primary Examiner*—Joseph F. Peters, Jr.
*Assistant Examiner*—Stephen P. Avila
*Attorney, Agent, or Firm*—Owen, Wickersham & Erickson

[57] ABSTRACT

A resiliently flexible wishbone boom comprised of a pair of boom sections attached to the pivotal mast of a sailboard. A sail located between the boom sections is attached by its leading edge to the mast and at one location along its trailing edge to the outer end of the boom. The boom has flexible forward portions which enable the boom sections to be drawn closer together, thereby making the boom longer and applying increased outhaul tension on the sail which changes its overall curvature and aerodynamic efficiency.

7 Claims, 12 Drawing Figures

VARIBLE OUTHAUL WISHBONE BOOM FOR BOARD SAILOR

This invention relates to a variable wishbone boom for a sailboard which functions to vary the curvature of the sail when the sailboard is underway.

BACKGROUND OF THE INVENTION

Sailboards typically include a buoyant board which is adapted to support a user on water, a mast which is connected to the board, a sail supported by the mast, and a boom which stretches the sail.

The sail is stretched between the mast and the aft end of the boom. With the boom securely mounted to the mast, the amount of outhaul position due to tension on the trailing edge of the sail determines the degree of curvature of the sail. Heretofore the user was able to set this curvature while on shore when "rigging" the sail by adjusting the tie-down tension on its trailing edge at the outer end of the boom. However, once the outhaul position was set there was no apparent means for changing this adjustment while the sailboard was underway and subject to variable wind and other sailing conditions.

The ability to modify the curvature of the sail can significantly affect the performance of the sailboard in the same way that the camber of an airplane wing and its angle of attack affects the wing lift. A "flatter" or low curvature sail gives optimum performance under high relative wing velocities, that is when the sailboard is tacking essentially upwind. Conversely, a high curvature sail produces optimum performance under low relative wind velocities, when the sailboard is moving more in a downwind direction. In addition, a "flatter" sail produces greater lift for steeper angles of attack relative to the wind. Thus, with the ability to flatten or reduce said curvature, a sailboard would be able to "point" further towards the wind direction and thereby enable the user to achieve optimum performance for all points of sail and for various wind speeds.

SUMMARY OF THE INVENTION

In accordance with the invention, a special wishbone boom for a sailboard is provided which allows the sailor to vary the curvature of the sail for a typical sailboard while moving, under sail. The boom has basically, a wishbone configuration comprised of two curved sections, each have a forward flexible member connected to a rear rigid member at their front ends, the boom sections are connected to a headpiece which secures the boom to the mast. At the rear ends of the boom sections, the rigid members are attached to a hinged aft end section which supports and retains a line connected to the trailing edge of the sail to maintain the outhaul force. A flexible cross line connects the two flexible boom components and is controllable by the user. By pulling on the cross line, the two flexible wishbone members can be brought closer together and this in turn causes an overall lengthening of the boom and consequently an outward movement of the aft end section which then applies more outhaul force to the sail to thereby reduce sail curvature. Conversely, letting out or reducing tension on the cross line produces the opposite effect on the boom, allowing its two sections to spread further apart, thereby shortening the boom, reducing the outhaul force and causing an increase in sail curvature. The cross line can be anchored to two internal jam cleats mounted inside the flexible boom pieces. This secures the inward and outward movement of the flexible pieces which in turn maintains the outhaul position at the desired position. In addition, the ends of the cross line are preferably anchored to the boom which forms small loops. A wind surfing harness which basically mounts a hook-like device to a sailor can be utilized to engage the cross line from each of the small loops, thereby enabling the movement and weight of the sailor to be utilized for the purposes of adjusting the boom length.

Other objects, advantages and features of the invention will become apparent from the following detailed description of one embodiment thereof, presented in conjunction with the accompanying drawings.

DETAILED DESCRIPTION OF EMBODIMENT

Figure 1:
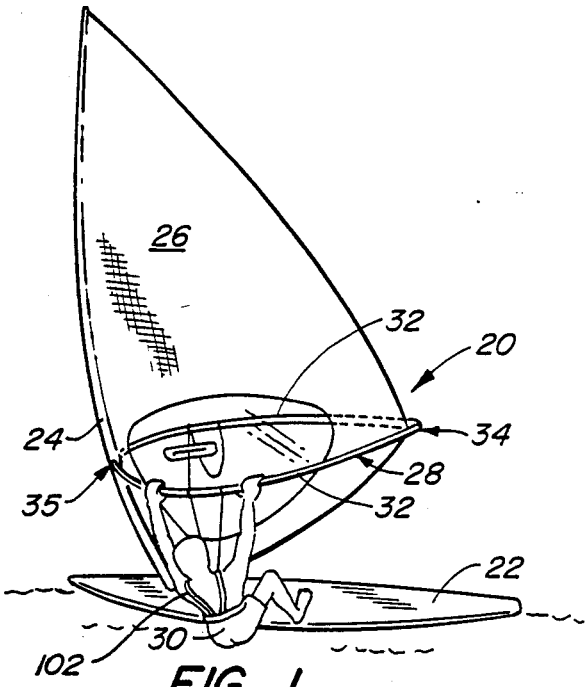
FIG. 1 is a view in perspective of a sailboard utilizing a variable boom embodying principles of the present invention.

Referring to the drawing, FIG. 1 illustrates a sailboard apparatus 20 as it appears in use and comprised of a sailing board 22, a mast 24, a sail 26, and a wishbone boom 28 embodying principles of the present invention attached to and extending from the mast. Using conventional sailboarding technique, the user or sailor 30 stands on one side of the board and grasps one side of the boom. In accordance with the present invention, the boom 28 is comprised of two curved boom sections 32 which can be pulled closer together or moved farther apart while the sailboard is underway. The outer or rear ends of the boom sections 32 are connected together at a pivotal aft end section 34 which is also connected by suitable means to the trailing edge of the sail 26. The sail is also connected to the mast at its forward or leading edge in the conventional manner, and the boom itself is pivotally connected to the mast by a headpiece fitting 35.

Figure 2A:
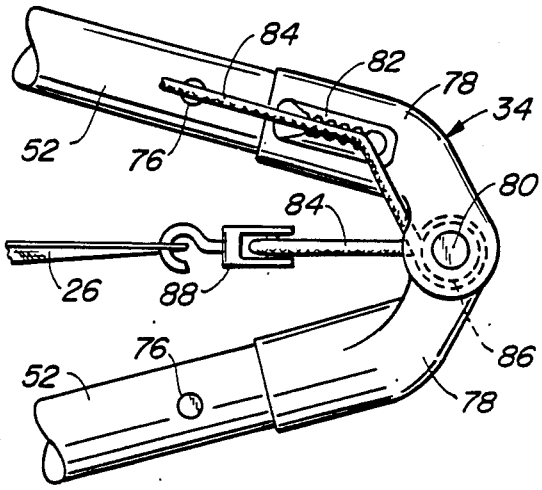
FIG. 2A is an enlarged fragmentary view of an aft end device for joining the two boom sections and holding the sail trailing edge.
Figure 2:
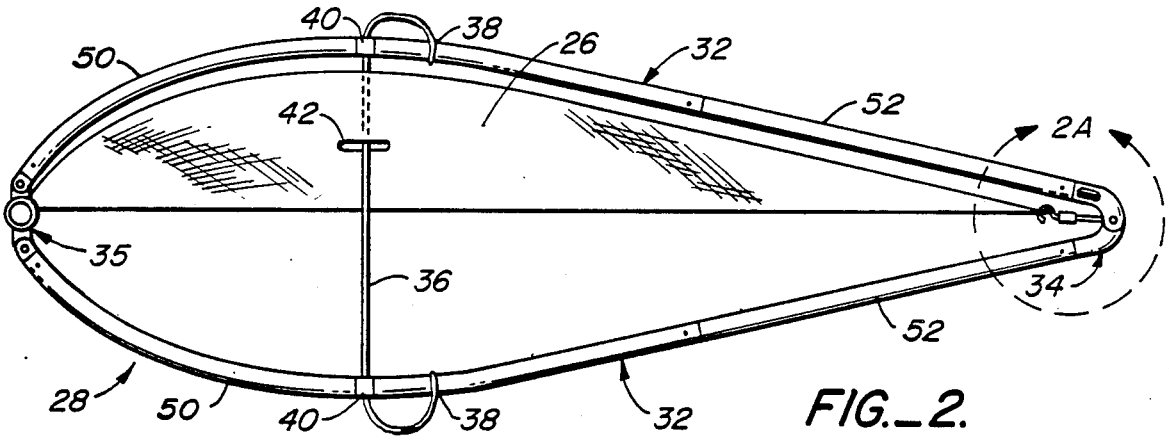
FIG. 2 is a plan view of the boom of FIG. 1 shown in its shortened mode for a sail having maximum curvature.
Figure 3:
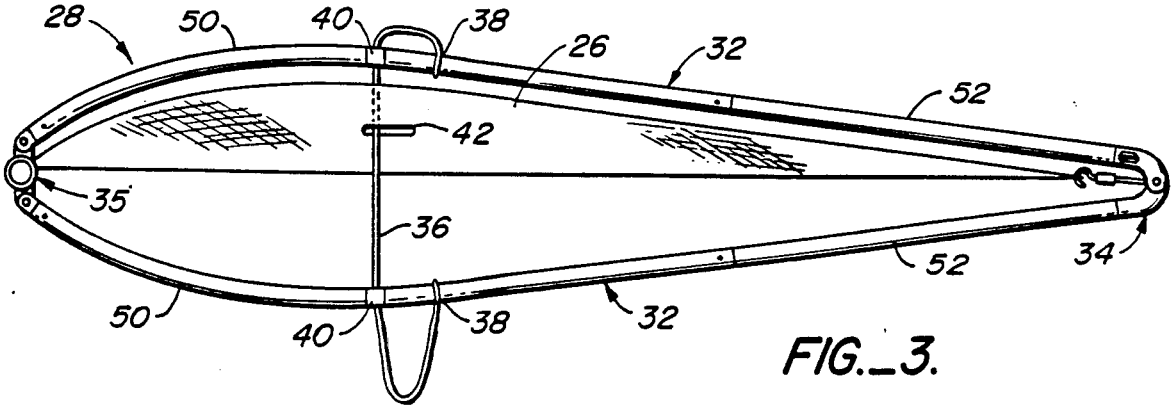
FIG. 3 is a plan view of the boom similar to FIG. 2 but with the boom shown in its lengthened mode for a sail with minimum curvature.

In accordance with the invention, as shown in FIG. 2, when the boom sections 32 are farthest apart, the total length of the boom is relatively short and conversely, as shown in FIG. 3, when the boom sections are brought closer together, the overall boom length increases. Since the outer or trailing end of the boom is connected to the sail, the lengthening of the boom (by pulling its two sections together) applies an outhaul force on the sail 26 which changes its shape by decreasing its curvature between the boom sections. The opposite effect happens to the sail, that is, its curvature increases, when the boom sections are moved farther apart.

Figure 6:
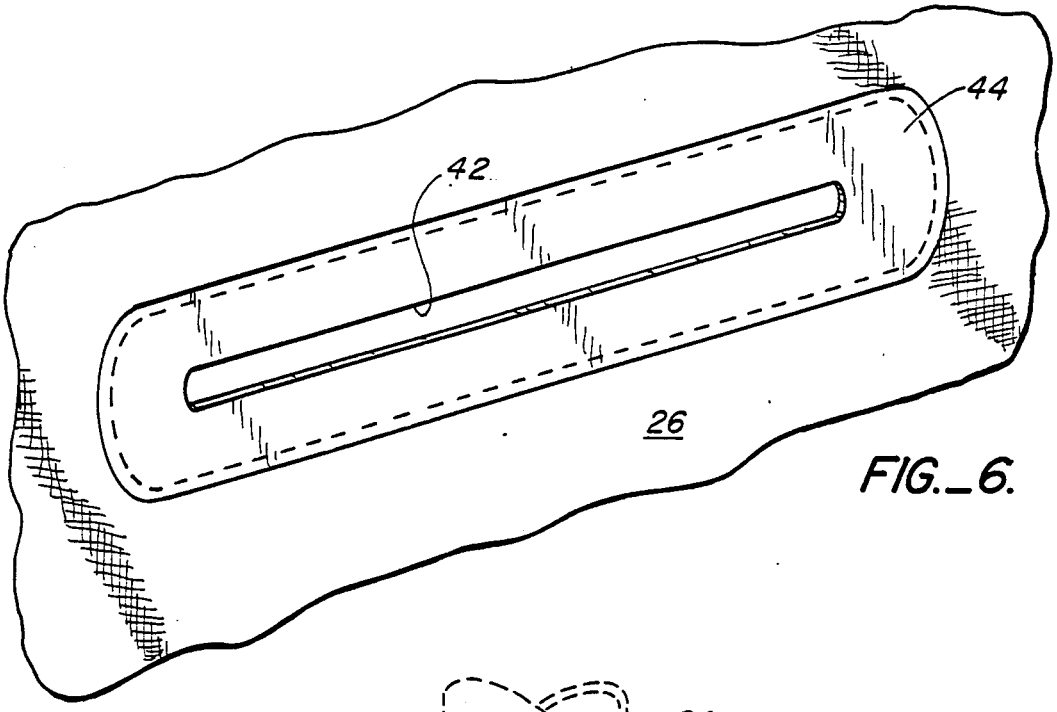
FIG. 6 is a fragmentary view in perspective showing a reinforced portion of the sail providing a slot for the boom control line.

The force for pulling the boom sections together is applied by means of a strong flexible control line 36 which is fastened at each of its opposite ends to a suitable tie-down fitting 38 on each boom section. Spaced forward from each fitting 38 is a jam cleat 40 through which the line 36 passes. The jam cleat 40 may be of a type which is commercially available and generally comprises a member with an elongated slot through which the control line can freely pass with an integral jaw portion at one end which will grip and hold the line in place when the line is forced into the jaw portion. The control line extends through a jam cleat on each boom section and through the sail 26 itself. As show in FIG. 6, an elongated slot 42 provided in the sail for the line 36 is surrounded by a planar reinforcing member 44 preferably made of heavier sheet material and fixed to the sail by adhesive bonding or stitching.

Figure 9:
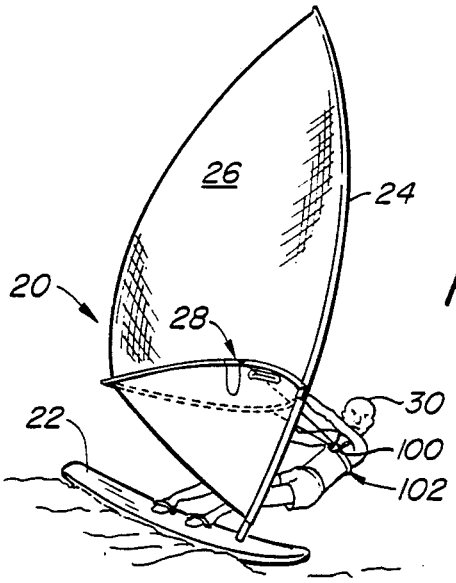
FIG. 9 is a view in perspective of a sailboard in use with a boom according to the invention and illustrating the attachment of the boom control line to the user.

As shown in FIGS. 1 and 9, the tension on line 36 is controlled by the sailor, and preferably it is looped through a suitable retaining device 100 preferably attached to a harness 102 worn by the sailor so that the line tension can be applied by the user's body movement without the necessity of grasping the control line with a hand. Thus, as shown in FIG. 1, the line 36 is held firmly by the jam cleat 40 on the boom section farthest from the sailor, and it passes freely through the jam cleat on the boom section nearest the sailor and through the sailor's retaining device. As the sailor moves his body and applies tension to the line 36, the outer boom section is drawn closer to the inner boom section, the boom becomes longer and thus applies outhaul tension on the sail 26 to reduce its curvature. When the sailor believes that the sail curvature is optimum for the existing wind conditions, the control line 36 can be manipulated in the near jam cleat to hold the boom in the desired shape and thus the sail in the desired configuration.

Figure 4:
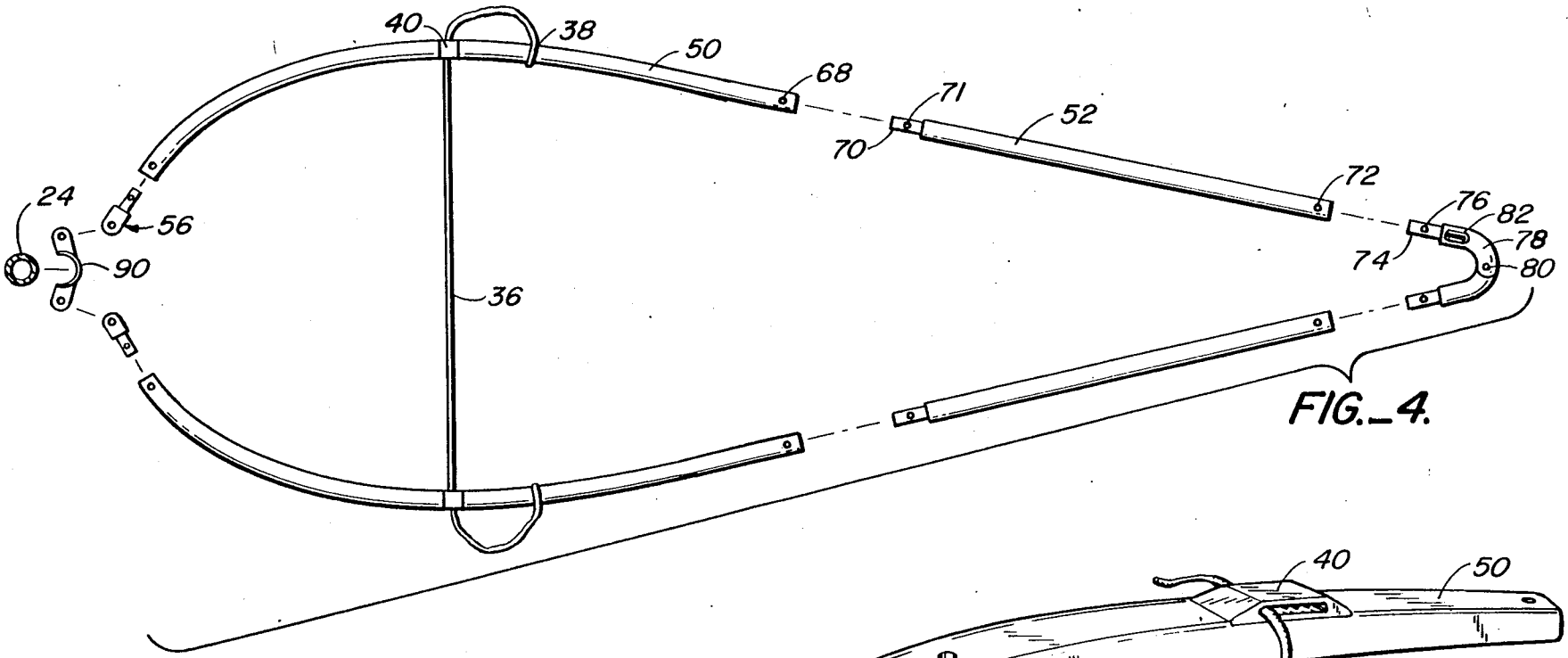
FIG. 4 is an exploded plan view of the boom according to the invention.

As shown in FIGS. 2 and 3 and also in FIG. 4, each boom section 32 is comprised of a semi-rigid but bendable or flexible forward member 50 whose forward end is pivotally attached to the mast 24. The rear end of this flexible forward member is connected to a rigid rear member 52 which is connected to the pivotal aft connector 34. These flexible forward members are somewhat analogous to leaf springs in that they can be bent by an external force but tend to return to their original shape when the force is reduced.

Figure 5:
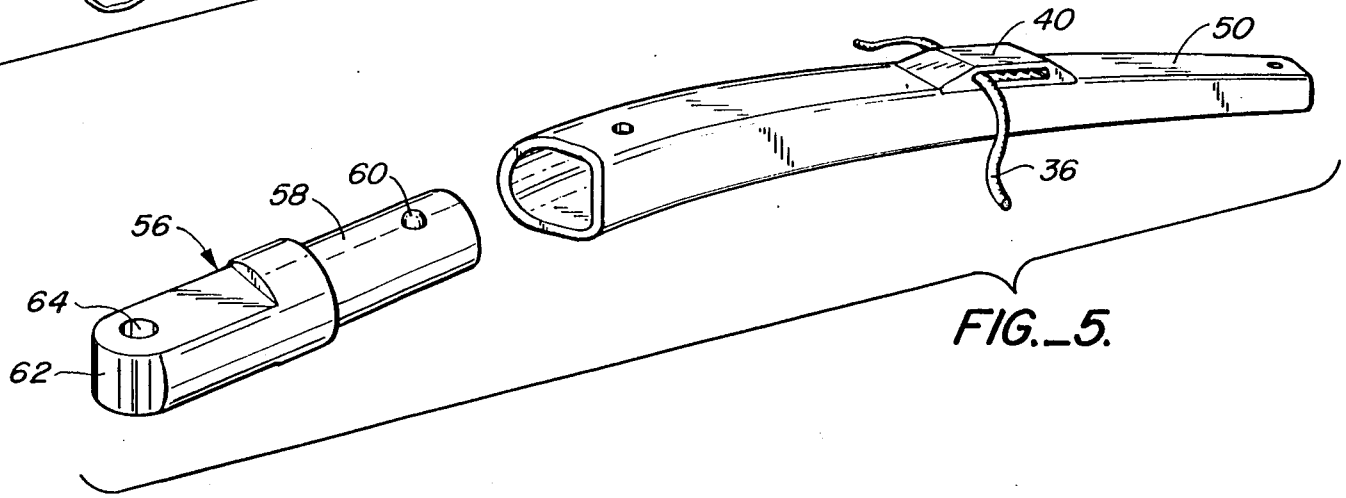
FIG. 5 is an enlarged fragmentary and exploded view in perspective showing a forward flexible portion of one boom section.

As shown in FIG. 5, each flexible forward portion 50 of the boom 28 is preferably made of a strong, durable plastic material such as pre-impregnated epoxy glass or carbon fiber material. In the embodiment shown, these flexible boom members have a hollow D-shape in cross section, and they may be formed on a mandrel with an initial slight curvature using conventional plastic lay-up techniques. However, it should be understood that other modes of manufacture and materials may be used for the flexible boom members 50 within the scope of the invention.

At the front end of each hollow flexible boom member 50, a connector member 56 is provided having a generally cylindrical portion 58 at one end that is slidably inserted and preferably retained by a spring loaded pin 60. The other end of the connector member 56 comprises a flat sided tongue portion 62 with a transverse hole 64 to facilitate its connection to the mast headpiece fitting 35.

The rear end of each hollow flexible boom member has a pair of aligned transverse holes 68 and is adapted to receive in sliding engagement a male forward end portion 70 of the rigid rear member 52. Each male end portion 70 is provided with spring loaded detent pins 72 that fit within the transverse holes 68.

A rear end portion of the rigid member 52 as shown in FIG. 4 is also hollow, has aligned transverse holes 72 and is adapted to receive in sliding engagement a male end portion 74 of the pivotal aft end section 34. The two male end portions 74 of the section 34 are both provided with spring loaded, outwardly projecting pins 76 that snap into the holes 72 when the members 52 and 34 are connected.

The pivotal aft end section 34 of the boom may be a component that is the same or similar to those used on conventional wishbone booms. As shown in FIG. 2A, it is comprised of two short arm members 78 which have the male end portions 74 at one end and are pivotally connected by a hinge pin 80 at their other end. One arm member is provided with an external cleat 82 for retaining a short line 84 which is tied to the trailing edge of the sail 26. This line is normally wrapped around a pulley wheel 86 which is mounted on the hinge pin 80 within the device 34. From the pulley wheel, the line 84 is attached to a hook fitting 88 which in turn is connected to the sail. Before the sailboard is launched, the leading edge of the sail is attached to the mast in the conventional manner, and the line 84 is attached to the trailing edge of the sail. The sail is then pulled to a desired outhaul position and the line 84 is secured by the cleat 82. Thereafter, the outhaul tension is controlled by the flexible boom 28 in accordance with the present invention.

Figure 7:
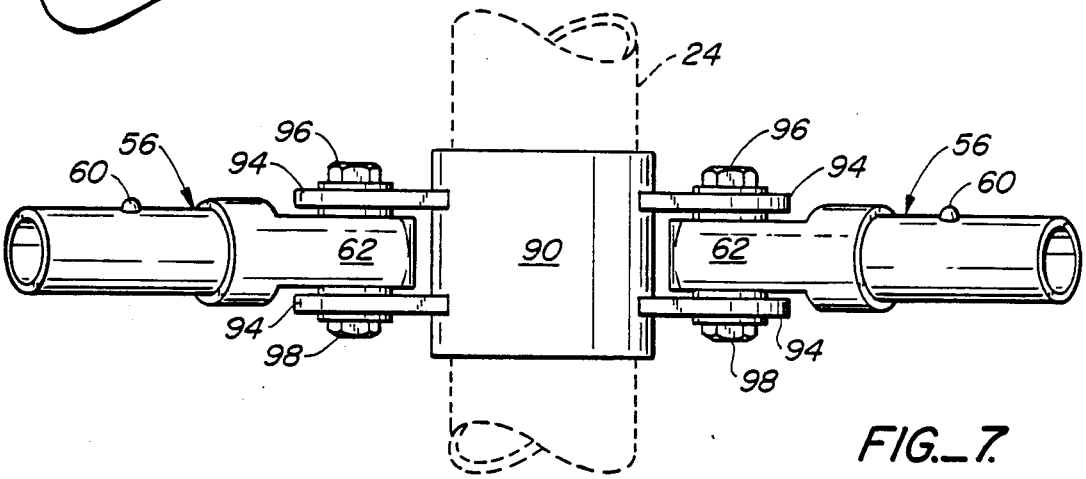
FIG. 7 is a view in elevation of the forward boom portion of the boom attached to a headpiece fitting on the mast according to the invention.
Figure 8:
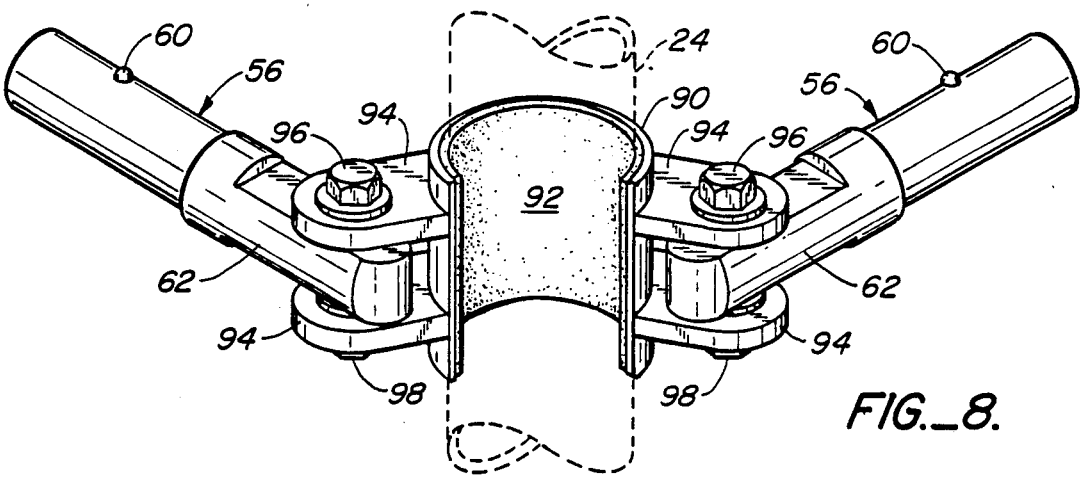
FIG. 8 is a view in perspective of the forward boom portion and mast connector headpiece fitting shown in FIG. 7.

At the forward end of the boom 28, each of its flexible members 50 is connected to the mast by means of the mast headpiece fitting 35. As shown in detail in FIGS. 7 and 8, this connector comprises a rigid split sleeve 90 that fits around the mast and has an inner liner 92 of friction reducing and wear resistant material such as polytetrafluoroethylene. Extending from opposite sides of the rigid sleeve are pairs of spaced apart retaining ears 94. Each pair of these ears has aligned transverse holes and they are spaced apart by a distance that is only slightly greater than the thickness of the tongue portion 62 on each flexible boom member connector 56. Thus, as shown in FIGS. 7 and 8, the flexible boom members 32 are pivotally connected to the mast when the tongue portion 62 of each boom section is located between a pair of projecting ears 94 and held in place by a bolt 96 which is retained by a nut 98 at one end.

Thus, as shown and described, each section 32 of the wishbone boom 28 is pivotally connected at both ends.

Since the forward member 50 of each section has itself a spring-like flexibility, the two boom sections can be pulled closer together by the control line 36, as shown in FIG. 3, thereby causing the boom to lengthen and thus pull the trailing edge of the sail to reduce its curvature. When tension on the control line 36 is reduced, the boom sections tend to spread farther apart due in part to the spring force of the forward members 50, as shown in FIG. 2, thereby providing a shorter boom length and a sail with more curvature.

Figure 10:
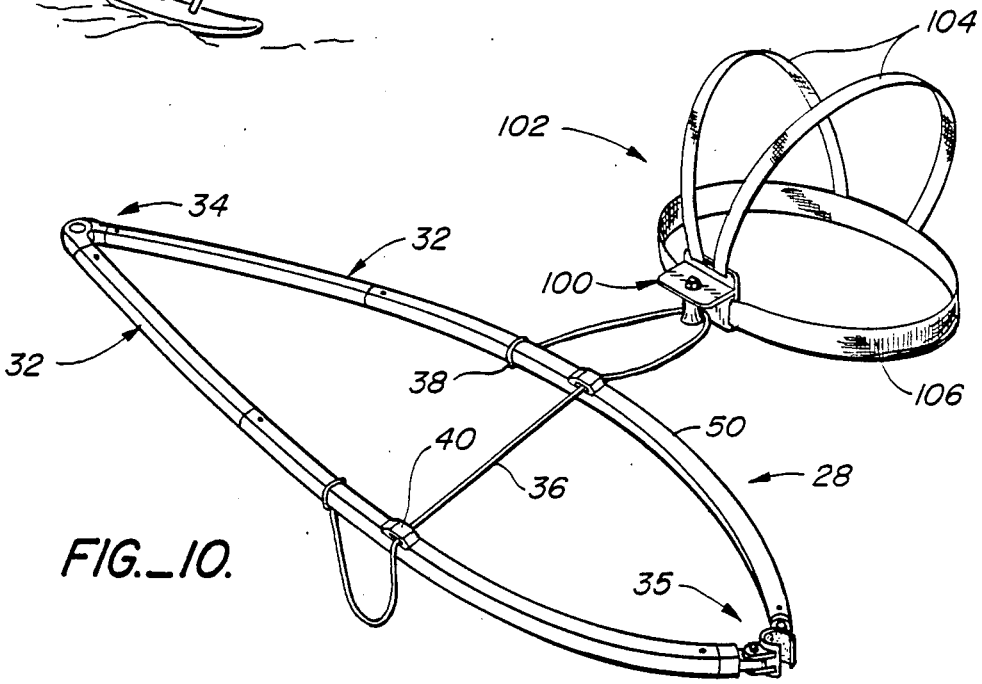
FIG. 10 is an exploded view in perspective of the flexible boom according to the invention and in combination with a retaining device attached to a harness worn by a user for engaging the boom control line.

Since a sailor, in operating a sailboard, must grasp the wishbone boom with both hands, he must use his body to apply the necessary tension to the control line 36 to change the shape of the boom and thus the outhaul tension on the sail as shown in FIG. 9. This tension is preferably accomplished by allowing the control line to pass around a hook-like retaining device 100 worn by the sailor, so that as his body is moved inwardly or outwardly, the tension on the control line 36 can be varied. As shown in FIG. 10, the retaining device 100 is attached to a harness 102 having flexible shoulder straps 104 and a waistband 106.

Figure 11:
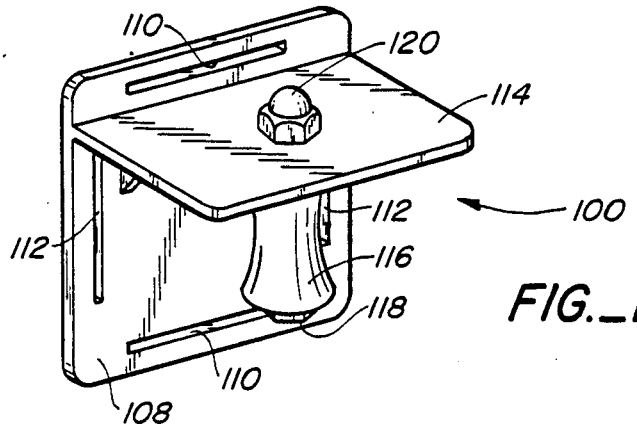
FIG. 11 is a view in perspective of a roller retainer for the boom control line which is attached to the harness of FIG. 10.

The hook-like device 100, as shown in greater detail in FIG. 11, has a vertical back plate 108 which has horizontal slots 110 to receive the shoulder straps near its upper and lower edges and vertical slots 112 to receive the waistband 106 near its opposite side edges. Extending outwardly at a right angle to the back plate 108 is a support member 114 for a roller pin 116. The latter extends downwardly from the support member at a right angle and is secured thereto by an axial bolt 118 that is threaded to a nut 120 on the upper side of the support member. The roller pin is preferably smoothly tapered from larger end portions to a smaller diameter at its midpoint so that it will readily retain the control line 36 when the latter is looped around the pin.

As seen in FIG. 10, when the control line is held tightly in the jam cleat 40 of the outer boom section 32 from the sailor and passes freely through the cleat of the boom section nearest the sailor and around the roller pin 116, movement of the sailor back and forth will control tension on the control line 36 and thus the distance between the boom sections, the boom length and the sail curvature.

As described, the adjustable, flexible boom 28 of the present invention affords a means for achieving greater efficiency and thus improved performance for sailboards by enabling it to adjust the sail curvature while underway. With increased experience, a sailor can readily adjust the boom configuration for each change in wind velocity and direction and thereby achieve increased sailboard speed and maneuverability.

What is claimed is:

1. For use on a sailboard having an upstanding mast and a sail attached to the mast, a flexible wishbone boom comprising:

a pair of curved boom sections connected together at their front and rear ends and having their concave sides facing each other, each said boom section comprising a forward member of resiliently flexible material connected to and axially aligned with a rearward member of rigid material, said flexible forward members enabling the boom sections to be drawn closer together and thereby cause the overall length of the boom to increase;

connector means attached to said flexible forward members of said boom sections for pivotally securing said boom to said mast;

pivotal aft end means for connecting the rear ends of said rigid rearward members of said boom sections together including means securing and applying tension to the trailing edge of the said sail; and a control means attached to said flexible forward members of said boom sections for enabling a person on the sailboard to exert a force for drawing the boom sections closer together while the sailboard is underway, thereby causing the entire boom to increase in length and exert an increased outhaul tension on said sail which changes its shape and operating efficiency.

2. The flexible wishbone boom as described in claim 1 wherein said flexible forward members are longer in length than said connected rigid members.

3. The flexible wishbone boom as described in claim 1 wherein said connector means on the front end of each said boom section comprises a tongue member adapted to fit between and be pin-connected to a pair of ears projecting from a sleeve collar on said mast.

4. The flexible wishbone boom as described in claim 1 wherein each said forward member is made of tubular plastic material having a generally D-shaped cross-section.

5. The flexible wishbone boom as described in claim 1 wherein said control means comprises a flexible line attached at its opposite ends to said boom sections.

6. The flexible wishbone boom as described in claim 5 including a jam cleat fixed to each said boom section through said flexible line passes, whereby a tension force on said line will enable said boom sections to be drawn closer together.

7. The flexible wishbone boom as described in claim 1 wherein said front end and said rear end boom sections have telescoping end portions with spring loaded detents adapted to fit with aligned holes of mating members to hold them together.

* * * * *